US008376812B2

(12) United States Patent
Li

(10) Patent No.: US 8,376,812 B2
(45) Date of Patent: Feb. 19, 2013

(54) GRINDER WITH BUILT-IN GRINDING AGENT DISPENSER

(75) Inventor: Longjiang Li, Ningbo (CN)

(73) Assignee: Ningbo Jinghengkaixiang Machinery Co., Ltd., Ningbo, Zhejiang (CN)

( * ) Notice: Subject to any disclaimer, the term of this patent is extended or adjusted under 35 U.S.C. 154(b) by 664 days.

(21) Appl. No.: 12/589,263

(22) Filed: Oct. 20, 2009

(65) Prior Publication Data

US 2011/0092140 A1 Apr. 21, 2011

(51) Int. Cl.
*B24B 19/00* (2006.01)

(52) U.S. Cl. ..... 451/180; 451/51; 451/60; 451/61; 451/450; 451/488

(58) Field of Classification Search ..... 451/51, 451/60, 178, 180, 449, 450, 488, 61
See application file for complete search history.

(56) References Cited

U.S. PATENT DOCUMENTS

| | | | | |
|---|---|---|---|---|
| 1,534,393 | A * | 4/1925 | Joseph | 451/51 |
| 5,085,014 | A * | 2/1992 | Sandhof | 451/51 |
| 5,800,252 | A * | 9/1998 | Hyatt | 451/61 |
| 6,524,173 | B1 * | 2/2003 | Nelson et al. | 451/178 |

* cited by examiner

*Primary Examiner* — Timothy V Eley
(74) *Attorney, Agent, or Firm* — Raymond Y. Chan; David and Raymond Patent Firm

(57) ABSTRACT

A grinder with built-in grinding agent dispenser includes a driving shank having an adapter end for operatively coupling with a grinder machine for being driven to rotate, a grinding shaft operatively coupling with the driving shank for being driven to rotate, an abrasive arrangement provided at the grinding shaft for refining a surface of a workpiece, and a grinding agent dispenser built-in within the grinder for guiding a flow of grinding agent. The dispenser has a supplying channel connected to a supplying inlet, and a grinding channel connected to a dispensing outlet and communicatively connected to the supplying channel, wherein the supplying channel and the grinding channel are provided within the driving shank and the grinding shaft, so that when the grinding agent is feeding into the supplying channel via the supplying inlet, the grinding agent is guided to flow to the dispensing outlet, so as to disperse grinding agent.

12 Claims, 3 Drawing Sheets

GRINDER WITH BUILT-IN GRINDING AGENT DISPENSER

BACKGROUND OF THE PRESENT INVENTION

1. Field of Invention

The present invention relates to a grinding machine, and more particularly to a grinder for polishing and mirror finishing a surface of a workpiece, wherein the grinder comprises a grinding agent dispenser built-in with the grinder for lubricating and/or cooling down the surface of the workpiece during the machining process of grinding.

2. Description of Related Arts

A grinding machine is commonly and widely used in the machining process for polishing, finishing, turning, or cutting a workpiece, e.g. a piece of wood or metal, so that the original material of the workpiece is able to be processed to a desired size, shape or quality via the grinding machine.

Traditionally, lubricants or cooling fluid are conducted in the grinding machining process in order enhance the quality of workpiece, such as a roughness of the workpiece surface. Most of the grinding machines, which is able to machine a relatively higher-grade mirror finishing surface, such as lower roughness (Ra≦0.1 μm), adapt a lubrication system for lubricating the surface of workpiece and the grinder tool of the grinding machine. The liquid lubricant or cooling agent is commonly supplied to the surfaces of workpiece and the grinder tool via incorporating a mercury oil dispensing system or manually delivering the lubricant or cooling agent to the surfaces by an operator.

During the actual machining process, the rolling tool of the grinder is contacting with the workpiece to form a substantially sealed or closed structure, so that the delivering of lubricant or cooling agent is a main concerning issue. It is hard to efficiently supply the lubricant to the workpiece or rolling tool surface to lubricate and cool down the temperature, which might keep increasing due to the fraction between the grinder tool surface and the workpiece while grinding.

Take the cylindrical grinder for example. While the grinding process, the grinder is usually moving in radius direction in related to the workpiece, i.e. either the grinder or the workpiece is rotatably driven to move, so that the grinder is able to rotatably grinding or refining the surface of the workpiece to achieve the purpose of polishing or mirror finishing process. The lubricant or cooling agent applied during the process may be splashed out while the spinning of the cylindrical grinder due to the centrifugal force of the grinder or workpiece. Therefore, the lubricant or machining oil may not be able to efficiently play the role for lubricating and/or cooling.

The increasing temperature during the grinding process may cause damages to the workpiece if cannot control the temperature under a certain requirement, such as reducing the residual stress, fatigue strength, or deforming the shape of the workpiece. When the cooling of the workpiece and the grinder tool during the grinding process is not timely, the life time of both of the workpiece and the grinder tool may be gradually reduced, and the accuracy of the machining process may be decreased.

Thus, in order to prevent not timely cooling or lubricating, the operator may either repeatedly smear over the surfaces of the workpiece and the grinder, or increase the mercury oil pump power to increase the flow of lubricant or cooling agent.

However, the amount of the lubricant or cooling agent being supplied during the grinder process is gradually increased. The over supplied lubricant or cooling agent may unevenly and overly cover part of the surface of the workpiece, so that the operator is unable to observe the changes at the surface of the workpiece. It is inconvenient for the operator to control the quality of the grinding process for processing the workpiece. Meanwhile, the maintenance and cleaning of the grinder tool is another concern. The structures of most of the existing grinders are hard to reach the inner tiny details. The grinder may have to be demolished or broken down to reach the gaps for cleaning. It is not only time consuming, but also increase the manufacturing cost.

SUMMARY OF THE PRESENT INVENTION

A main object of the present invention is to provide a grinder with a built-in grinding agent dispenser, which is able to dispensing the grinding agent during a grinding process for refining a workpiece without extra dispensing system or manually delivering the grinding agent to the surface of the workpiece and the abrading elements.

Another object of the present invention is to provide a grinder with built-in grinding agent dispenser, wherein the grinding agent is dispersed out of the dispensing outlet to the abrading elements by centrifugal force, so that no substantively pumping system is required during the refining process.

Another object of the present invention is to provide a grinder with built-in grinding agent dispenser, wherein the grinding channel and the supplying channel are formed within the grinder, so that the grinding agent is able to be dispersed toward the outer circumferential surface of the grinding shaft, so as to dispense the grinding agent at the abrading elements.

Another object of the present invention is to provide a grinder with built-in grinding agent dispenser, wherein the grinding agent is dispensed out of the grinding shaft to apply onto the surface of the workpiece so as to wash out the residue on the surface of the workpiece during the grinding process.

Another object of the present invention is to provide a grinder with built-in grinding agent dispenser, which can minimize the usage of the grinding agent while maximizing the lubricating and cooling effects at the surface of the workpiece.

Another object of the present invention is to provide a grinder with built-in grinding agent dispenser, wherein the holding seat of the supplying arrangement is at a stationary status, while the grinding shaft is driven to rotate.

Another object of the present invention is to provide a grinder with built-in grinding agent dispenser, wherein the grinding agent dispenser is simple in structure, so as to minimize the manufacturing cost of the grinder incorporating with the grinding agent dispenser.

Another object of the present invention is to provide a grinder with built-in grinding agent dispenser, wherein the grinder is able to incorporate with any exiting grinding machine for refining the surface of the workpiece.

Accordingly, in order to accomplish above objectives, the present invention provides a grinder, which comprises a driving shank, a grinding shaft operatively coupling with the driving shank, an abrasive arrangement provided at the grinding shaft for refining a surface of a workpiece, and a grinding agent dispenser built-in within the grinder for guiding a flow of grinding agent.

The driving shank has a coupling end and an opposed adapter end for operatively connecting with a grinding machine.

The grinding shaft has a driving portion coupling with the coupling end of the driving shank, and an opposed free end portion arranged to be rotated when the driving portion is driven to rotate by the driving shank.

The abrasive arrangement comprises a plurality of abrading elements spacedly and radially provided at the free end portion of the grinding shaft at an outer circumferential surface thereof, such that when the grinding shaft is driven to rotate, the abrading elements are adapted for refining the workpiece surface.

The grinding agent dispenser comprises a guiding channel longitudinally provided within the grinding shaft from the driven portion towards the free end portion, and at least a dispensing channel radially extended from the grinding channel at a position adjacent to the abrading elements for evenly dispensing the grinding agent towards the abrading elements by a centrifugal force of the grinding shaft for optimizing an operative condition of the abrading elements during refining the workpiece surface.

These and other objectives, features, and advantages of the present invention will become apparent from the following detailed description, the accompanying drawings, and the appended claims.

DETAILED DESCRIPTION OF THE PREFERRED EMBODIMENT

Figure 1:
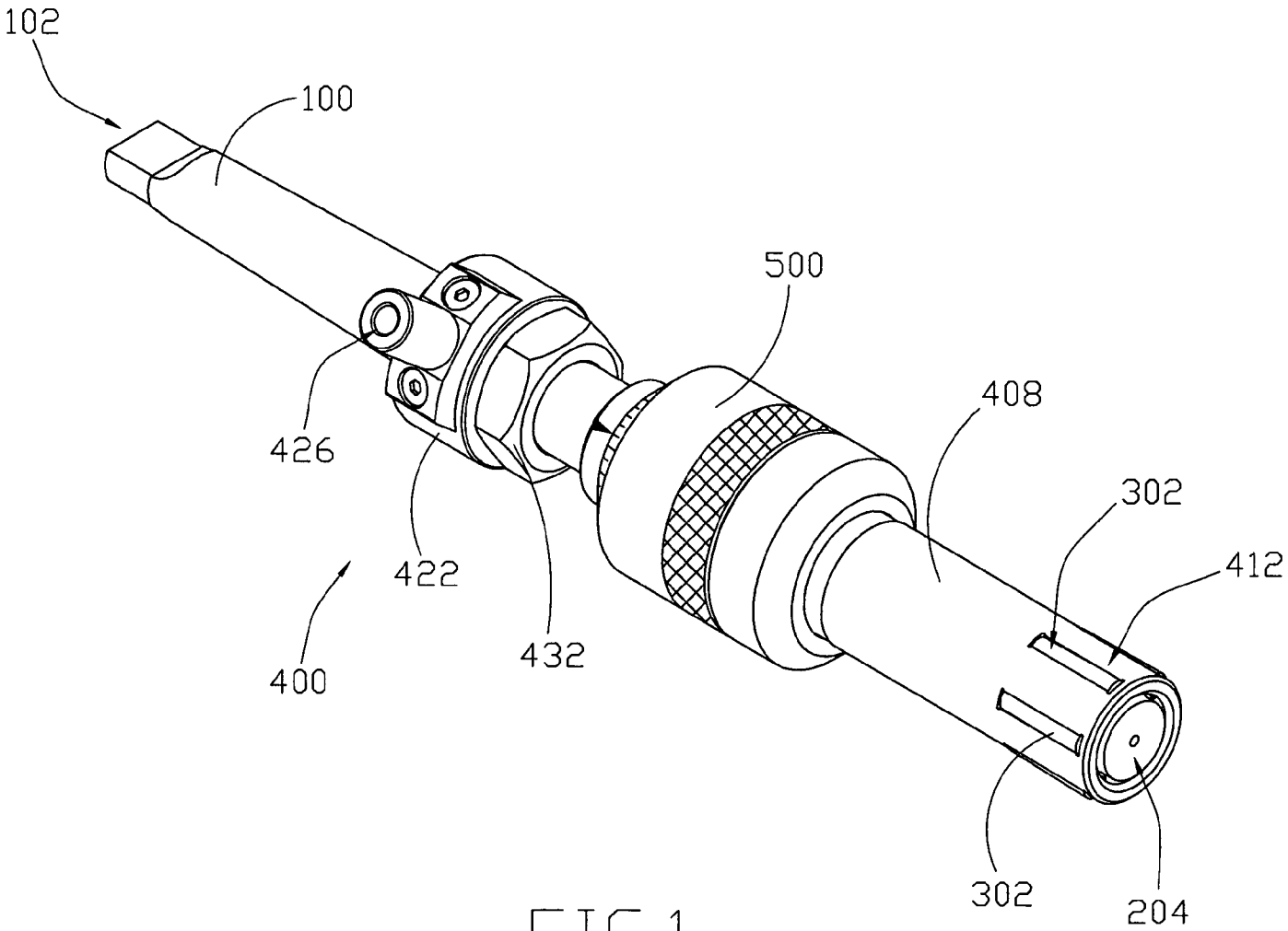
FIG. 1 is a perspective view of a grinder with built-in grinding agent dispenser according to a preferred embodiment of the present invention.
Figure 2:
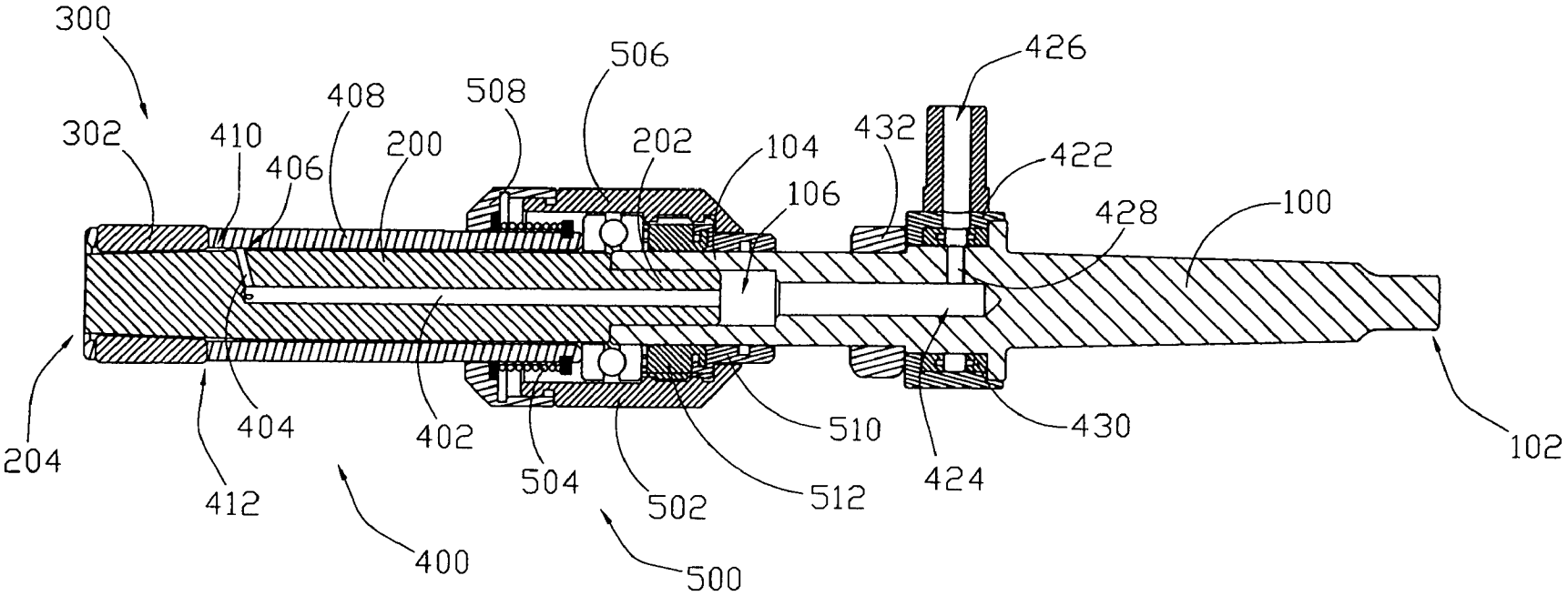
FIG. 2 is a longitudinal section view of the grinder with built-in grinding agent dispenser according to the above preferred embodiment of the present invention.
Figure 3:
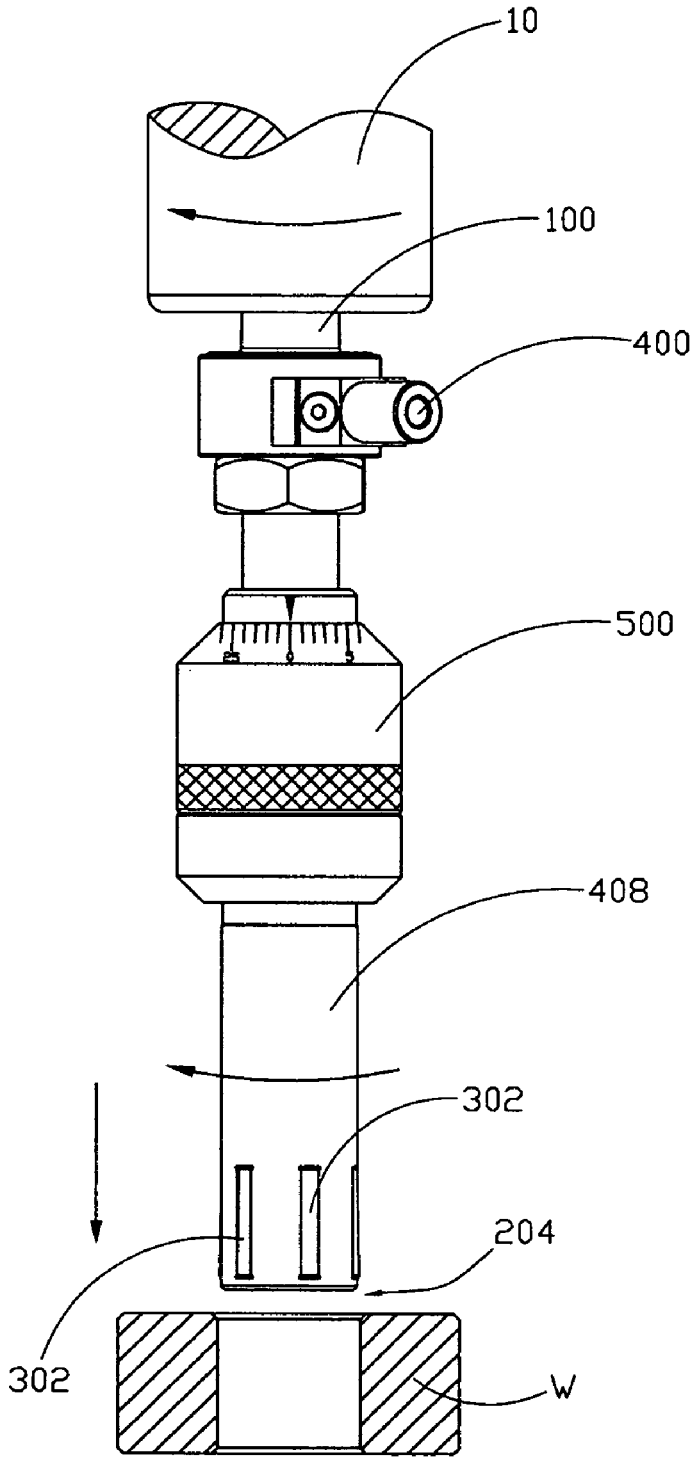
FIG. 3 is another perspective view of the grinder with built-in grinding agent dispenser according to the above preferred embodiment of the present invention, illustrating the grinder operatively coupling with a grinding machine for being driven to rotate for refining a surface of a workpiece.

Referring to FIGS. 1 to 3 of the drawings, a grinder with built-in grinding agent dispenser according to a preferred embodiment of the present invention is illustrated, wherein the grinder comprises a driving shank 100, a grinding shaft 200 operatively coupling with the driving shank 100, an abrasive arrangement 300 provided at the grinding shaft 200 for refining a surface of a workpiece W, and a grinding agent dispenser 400 built-in within the grinder for guiding a flow of grinding agent.

The driving shank 100 has an adapter end 102 for operatively connecting to a grinding machine 10 for being driven to rotate, and an opposed coupling end 104 for coupling with the grinding shaft 200. It is appreciated that the adapter end 102 of the driving shank 100 preferably has a non-circular shape, such as elliptic shape or substantially rectangular shape, so that it is able to sufficiently being driven by the grinding machine 10 to rotate.

The grinding shaft 200 has a driving portion 202 and an opposed free end portion 204, wherein the driving portion 202 is coupling with the coupling end 104 of the driving shank 100, wherein the grinding shaft 200 is coaxially extended from the driving shank 100 end-to-end. Accordingly, when the grinding machine 10 generates a rotatable output to drive the driving shank 100 to rotate, the grinding shaft 200 is driven to correspondingly rotate. Therefore, the free end portion 204 of the grinding shaft 200 is arranged to be driven to rotate when the driving portion 202 is driven by the driving shank 100.

The abrasive arrangement 300 further comprises a plurality of abrading elements 302 radially and spacedly provided at an outer circumferential surface of the grinding shaft 200 at the free end portion 204 thereof. Therefore, when the driving shaft 200 is driven to rotate, the abrading elements 302 are arranged to refine the surface of the workpiece W. In other words, the workpiece W is securely positioned at a position that the abrading elements 302 is contacting with the workpiece W surface for refining thereof, such as grinding, polishing, or mirror finishing.

Accordingly, the grinding agent dispenser 400 further comprises a grinding channel 402 and at least a dispensing channel 404 communicatively connected to the grinding channel 402 for dispensing the grinding agent from the grinding channel 402 to the dispensing channel 404. The grinding channel 402 is longitudinally extending within the grinding shaft 200 from the driving portion 202 towards the free end portion 204 of the grinding shaft 200. The dispensing channel 404 is preferred to radially extend from the grinding channel 402 toward the outer circumferential surface of the grinding shaft 200.

Preferably, the dispensing channel 404 extended from the grinding channel 402 is located at a position adjacent to the abrading elements 302 at the outer circumferential surface of the free end portion 204 of the grinding shaft 200, such that the dispensing channel 404 of the grinding agent dispenser 400 is able to evenly dispensing the grinding agent towards the abrading elements 302 by a centrifugal force of the grinding shaft 200, when the driving shank 100 is being driven by the grinding machine 10 to drive the grinding shaft 200 to rotate.

Thus, the grinding agent of the dispenser 400 is able to deliver the grinding agent to the abrading elements 302, so as to optimize an operative condition of the abrading elements 302 during refining the workpiece W surface. For example, during the refining process of grinding the surface of the workpiece W to achieve the roughness of the workpiece W surface is less than 0.1 ($R_a \leqq 0.1$ μm) by the friction between surfaces of abrading elements 302 and the workpiece W. The grinding agent may be able to lubricate, cool the high temperature generated due to the fraction from the high speed rotation of the grinding shaft 200 between the interface of the abrading elements 302 and the workpiece W surface, and/or clean the surfaces, such as removing the swarf or residue. Therefore, the timely dispensing the grinding agent to the interface between the workpiece W and the abrading elements 302 is able to insure the quality of the workpiece W.

As best shown in FIG. 2, the grinding channel 402 is preferred to coaxially form at a center portion of the grinding shaft 200 to define a hollow portion of the grinding shaft 200, so as to guide the flow of the grinding agent to pass therewithin. The dispensing channel 404 is preferred to radially extend from the grinding channel 402 in an end-to-end manner to form a dispensing outlet 406 at the outer circumferential surface of the grinding shaft 200, so as to sufficiently dispense the grinding agent to the abrading elements 302 at the free end portion 204 of the grinding shaft 200 via the centrifugal force, when the grinding shaft 200 is driven to rotate.

As mentioned above, the grinding agent dispenser 400 further comprises a retention sleeve 408 provided at the outer circumferential surface of the grinding shaft 200, wherein the retention sleeve 408 is coaxially encircling with the grinding shaft 200 to define a dispensing clearance 410 between the outer circumferential surface of the grinding shaft 200 and an inner circumferential surface of the retention sleeve 408. Therefore, the grinding agent is dispensed to fill out the dispensing clearance 410 through the dispensing outlet 406, and then being delivered to the abrading elements 302 and the workpiece W surface via centrifugal force through the dispensing clearance 410. In other words, when the grinding shaft 200 is driven to rotate, the grinding agent is filled within the dispensing clearance 410 to gradually disperse the grinding agent at the abrading elements 302, so as to dispense to the surface of the workpiece W for minimizing the usage of the grinding agent. Preferably, the free end portion 204 of the grinding shaft 200 has a conical shape and the retention sleeve 408 has a tubular shape, such that when the retention sleeve 408 encircles with the grinding shaft 200, the dispensing clearance 410 is formed between the outer circumferential surface of the grinding shaft 200 at the free end portion 204 thereof and an inner circumferential surface of the retention sleeve 408.

Therefore, the retention sleeve 408 further comprises a plurality of retentions slots 412 spacedly formed at a free end portion of the retention sleeve 408 corresponding to the free end portion 204 of the grinding shaft 200. The retention slots 412 are adapted for securely engaging with the abrading elements 302 respectively, such that the abrading elements 302 are retained at the free end portion 204 of the grinding shaft 200. Thus, the abrading elements 302 are able to stably being retained in position to prevent any lateral movements of abrading elements 302 during grinding process.

In order to conveniently feed the grinding agent into the grinding channel 402 to the dispensing channel 404, the grinding agent dispenser 400 further comprises a supplying arrangement 420, wherein the supplying arrangement 420 comprises a holding seat 422, a supplying channel 424 communicatively connected to the grinding channel 402, and a supplying inlet 426 for supplying the grinding agent to the supplying channel 424 through the supplying inlet 426.

The holding seat 422 is rotatably encircling with the driving shank 100. The supplying channel 424 is longitudinally provided within the driving shank 100 to communicate with the grinding channel 402 for supplying the grinding agent thereto, wherein the supplying channel 424 may be coaxially formed within the driving shank 100 to form a hollow portion therewithin, so as to longitudinally align with the grinding channel 402 to communicate therewith. The supplying inlet 426 is provided at the holding seat 422 to communicate with the supplying channel 424, so that the grinding agent is fed into the supplying channel 424 through the supplying inlet 426, so as to feed the grinding agent to the grinding channel 402 through the supplying channel 424.

Accordingly, the supplying arrangement 420 may further comprises at least a supplying groove 428 radially and outwardly extended from the driving shank 100, so as to communicate with the supplying inlet 426 for feeding the grinding agent through the supplying groove 428 to the supplying channel 424.

In other words, the holding seat 422 has an indented cavity having a substantially circular shape formed within the holding seat 422, so as to form a sealed cavity between the holding seat 422 and an outer circumferential surface of the driving shank 100. Therefore, the grinding agent is conveyed from the supplying inlet 426 to fill the indented cavity of the holding seat 422 for communicatively supplying the grinding agent into the supplying channel 424 through the supplying groove 428. Thus, the holding seat 422 is at a stationary status while the driving shank 100 is being driven to rotate. Preferably, the grinding agent is fed into the supplying channel 424 through the supplying inlet 426 when the driving shank 100 is stationary.

Therefore, the supplying inlet 426 is able to continuously supply the grinding agent into the grinding channel 402 through the supplying channel 424. More specifically, the holding seat 422 rotatably coupling with the driving shank 100 is stationary while the driving shank 100 is being driven to rotate, such that the holding seat 422 and the supplying inlet 426 of the supplying arrangement 420 is able to not concurrently rotate with the supplying channel 424, grinding channel 402, and the dispensing channel 404. Thus, the grinding agent is able to be continuously or automatically supplied to the dispensing outlet 406 via the grinding agent liquid pressure and the centrifugal force from the rotation of the grinding shaft 202.

As described above, the guiding channel 402 and dispensing channel 404 are preferred to integrally form with the grinding shaft 200. The supplying channel 424 and the supplying groove 428 may be integrally formed with the driving shank 100, such that the structure of the grinder is simplified, so as to minimize the manufacturing cost.

One or more sealing elements 430 may further be provided at a gap of the indented cavity between the outer circumferential surface of the driving shank 100 and the holding seat 422 to prevent any leaking of the grinding agent when being filled within the indented cavity of the holding seat 422 through the supplying inlet 426.

In order to securely retain the holding seat 422 in position, at least a positioning element 432 is preferably provided to limit the related movement between the driving shank 100 and the holding seat 422 in the longitudinal axis direction of the grinder, while the driving shank 100 is driven by the grinding machine 10 to rotate. The positioning element 432 is embodied as a screw nut coupling at the outer circumferential surface of the driving shank 100, as shown in FIGS. 1 to 3.

As will be immediately appreciated by one skill in the art, a diameter of the supplying channel 424 may be greater than a diameter of the grinding channel 402, so that the diameter of the supplying channel 424 enables the grinding agent being sufficiently delivered to the supplying channel 424. The slightly smaller diameter of the grinding channel 402 is able to gradually and evenly being distributed for coating, lubricating, cooling, or cleaning the surfaces of the workpiece W and the abrading elements 302. The larger diameter of the supplying channel 424 may also provide a pressure, such as an oil pressure by a lubricant of the grinding agent, for dispensing the grinding agent to the abrading elements 302.

As shown in FIG. 2, a sliding cavity 106 is further formed at the coupling end 104 of the driving shank 100 coupled with the driving portion 202 of the grinding shaft 200. The sliding cavity 106 of the driving shank 100 is preferred to be coaxially provided at the coupling end 104 of the driving shank 100 and sealedly engaging with the driving portion 202 of the grinding shaft 200 in a longitudinal direction. Thus, the distance between the free end portion 204 of the grinding shaft 200 and the adapter end 102 of the driving shank 100 is able to be selectively adjusted.

Accordingly, the grinding agent is filled within the sliding cavity 106 to communicatively supply the grinding agent from the supplying channel 424 to the grinding channel 402 for dispensing the grinding agent out of the dispensing outlet 406, so as to form a buffering zone for temporarily storing the grinding agent therein.

A size adjustable arrangement 500 may be further provided at a position between the driving shank 100 and the grinding shaft 200, so that the radial position of each of the abrading elements 302 is able to be selectively adjusted via the size adjustable arrangement 500. The size adjustable arrangement 500 further comprises a sleeve adjustor 502 rotatably coupling with the coupling end 104 of the driving shank 100 and a resilient element 504 coaxially mounted at the grinding shaft 200 within the sleeve adjustor 502 for applying an urging force against an inner wall of the sleeve adjustor 502. As shown in FIG. 3, the sleeve adjustor 502 comprises a first casing 506 coaxially coupling with the coupling end 104 of the driving shank 100 and a second casing 508 which is coaxially coupling with the driving portion 202 of the grinding shaft 200 and is slidably coupling with the first casing 506. The size adjustable arrangement 500 further comprises a retention gear 510 provided within the first casing 506 and an adjustable gear 512 coaxially coupling at the coupling end 104 of the driving shank 200 to normally engage with the retention gear 510 and the inner threaded portion of the first casing 506, wherein when the first casing 506 is upwardly slid towards the adapter end 102 of the driving shank 100, i.e. away from the second casing 508, the retention gear 510 is disengaged with the adjustable gear 512. Therefore, when the sleeve adjustor 502 is rotated, the adjustable gear 512 is driven to rotate so as to drive the retention sleeve 408 to rotate around the grinding shaft 200. Since the free end portion 204 of the grinding shaft 200 has a conical shape, the abrading elements 302 are pushed radially to adjust the radial position thereof with respect to the grinding shaft 200. In other words, the distance between each of the abrading elements 302 and the center of the grinding shaft 200 will be selectively adjusted by the rotation of the retention sleeve 408.

The grinding agent is provided for enhancing or ensuring the quality of the workpiece W during the refining process via the grinder. The grinding agent may be provided for lubricating, cooling, cleaning or other purposes to ensure and minimize any possible damages from the refining process of the grinder. Therefore, the grinding agent may be an oil, lubricant, cooling agent, cleaning agent, or any combinations of the above, such as a grinding agent for lubricating, cooling, and cleaning to finish the refining process.

Accordingly, when the grinding agent is dispersed out of the dispensing outlet 406 to evenly distribute to the abrading elements 302 to the workpiece W surface, the swarf or other residues are able to be washed out with the grinding agent by the centrifugal force and/or the grinding agent pressure. The grinding agent may also be dispersed to lubricate the interface of the abrading elements 302 and the workpiece W surface during the high speed rotational refining process, and to cool down the temperature from the fraction at the interface, so as to minimize the damages of the workpiece W to reduce the quality, such as reducing residual stress and fatigue strength due to the high temperate at the interface.

The grinder with built-in grinding agent dispenser of the present invention may be able to incorporating of the grinding machine 10 of lathe, drill press, milling machine, and boring machine. The above preferred embodiment of the present invention is embodied to refine an inner surface of the workpiece W having a substantially circular or elliptic shaped cross-section. It will be readily appreciated that the grinder with built-in grinding agent dispenser is able to refine an outer surface of the workpiece W or other types and shapes grinder.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A grinder for refining of a workpiece surface, comprising:

a driving shank having a coupling end and an opposed adapter end for operatively connecting with a grinding machine;

a grinding shaft having a driving portion coupling with said coupling end of said driving shank and an opposed free end portion arranged to be rotated when said driving portion is driven to rotate by said driving shank;

an abrasive arrangement which comprises a plurality of abrading elements spacedly and radially provided at said free end portion of said grinding shaft at an outer circumferential surface thereof such that when said grinding shaft is driven to rotate, said abrading elements are adapted for refining said workpiece surface; and a grinding agent dispenser for guiding a flow of grinding agent, comprising:

a guiding channel longitudinally provided within said grinding shaft from said driven portion towards said free end portion;

at least a dispensing channel radially extended from said grinding channel at a position adjacent to said abrading elements for evenly dispensing said grinding agent towards said abrading elements by a centrifugal force of said grinding shaft for optimizing an operative condition of said abrading elements during refining said workpiece surface; and a retention sleeve coaxially encircling said grinding shaft and defining a dispensing clearance between said outer circumferential surface of said grinding shaft and an inner circumferential surface of said retention sleeve, such that when said grinding shaft is driven to rotate, said grinding agent is filled in said dispensing clearance to be gradually dispensed at said abrading elements, wherein said retention sleeve further has a plurality of retention slots spacedly formed at a free end thereof to securely engage with said abrading elements at said retention slots so as to retain said abrading elements at said free end of said grinding shaft.

2. A grinder for refining of a workpiece surface, comprising:

a driving shank having a coupling end and an opposed adapter end for operatively connecting with a grinding machine;

a grinding shaft having a driving portion coupling with said coupling end of said driving shank and an opposed free end portion arranged to be rotated when said driving portion is driven to rotate by said driving shank;

an abrasive arrangement which comprises a plurality of abrading elements spacedly and radially provided at said free end portion of said grinding shaft at an outer circumferential surface thereof such that when said grinding shaft is driven to rotate, said abrading elements are adapted for refining said workpiece surface; and a grinding agent dispenser for guiding a flow of grinding agent, comprising:

a guiding channel longitudinally provided within said grinding shaft from said driven portion towards said free end portion;

at least a dispensing channel radially extended from said grinding channel at a position adjacent to said abrading elements for evenly dispensing said grinding agent towards said abrading elements by a centrifugal force of said grinding shaft for optimizing an operative condition of said abrading elements during refining said workpiece surface, wherein said guiding channel is coaxially formed with respect to said grinding shaft at a center thereof to define a hollow portion of said grinding shaft for guiding said grinding agent flowing along said grinding shaft; and a retention sleeve coaxially encircling said grinding shaft and defining a dispensing clearance between said outer circumferential surface of said grinding shaft and an inner circumferential surface of said retention sleeve, such that when said grinding shaft is driven to rotate, said grinding agent is filled within said dispensing clearance to be gradually dispensed at said abrading elements, wherein said retention sleeve further has a plurality of retention slots spacedly formed at a free end thereof to securely engage with said abrading elements at said retention slots so as to retain said abrading elements at said free end of said grinding shaft.

3. A grinder for refining of a workpiece surface, comprising:

a driving shank having a coupling end and an opposed adapter end for operatively connecting with a grinding machine;

a grinding shaft having a driving portion coupling with said coupling end of said driving shank and an opposed free end portion arranged to be rotated when said driving portion is driven to rotate by said driving shank;

an abrasive arrangement which comprises a plurality of abrading elements spacedly and radially provided at said free end portion of said grinding shaft at an outer circumferential surface thereof such that when said grinding shaft is driven to rotate, said abrading elements are adapted for refining said workpiece surface; and a grinding agent dispenser for guiding a flow of grinding agent, comprising:

a guiding channel longitudinally provided within said grinding shaft from said driven portion towards said free end portion;

at least a dispensing channel radially extended from said grinding channel at a position adjacent to said abrading elements for evenly dispensing said grinding agent towards said abrading elements by a centrifugal force of said grinding shaft for optimizing an operative condition of said abrading elements during refining said workpiece surface, wherein said guiding channel is coaxially formed with respect to said grinding shaft at a center thereof to define a hollow portion of said grinding shaft for guiding said grinding agent flowing along said grinding shaft, wherein said dispensing channel is radially extended from said guiding channel to form a dispensing outlet at said outer circumferential surface of said grinding shaft; and a retention sleeve coaxially encircling said grinding shaft and defining a dispensing clearance between said outer circumferential surface of said grinding shaft and an inner circumferential surface of said retention sleeve, such that when said grinding shaft is driven to rotate, said grinding agent is filled in said dispensing clearance to be gradually dispensed at said abrading elements, wherein said retention sleeve further has a plurality of retention slots spacedly formed at a free end thereof to securely engage with said abrading elements at said retention slots so as to retain said abrading elements at said free end of said grinding shaft.

4. The grinder, as recited in claim 3, wherein said grinding agent dispenser further comprises a supplying arrangement for feeding said grinding agent to said guiding channel, wherein said supplying arrangement comprises a holding seat rotatably encircling with said driving shank, a supplying channel longitudinally provided within said driving shank to communicate with said guiding channel, and a supplying inlet provided at said holding seat for feeding said grinding agent into said guiding channel through said supplying channel.

5. The grinder, as recited in claim 4, wherein said supplying arrangement further has at least a supplying groove radially and outwardly extended from said driving shank to communicate said supplying channel with said supplying inlet for supplying said grinding agent from said supplying inlet to said supplying channel through said supplying groove when said driving shank is idle.

6. The grinder, as recited in claim 5, wherein a diameter of said supplying channel is larger than a diameter of said guiding channel.

7. The grinder, as recited in claim 5, wherein said driving shank has a sliding cavity coaxially provided at said coupling end thereof for slidably and sealedly engaging with said driving portion of said grinding shaft in a longitudinal direction, so as to selectively adjust a distance between said free end of said grinding shaft and said adapter end of said driving shank.

8. The grinder, as recited in claim 7, wherein said grinding agent is a mixture of lubricant agent and cooling agent.

9. A grinder for refining of a workpiece surface, comprising:

a driving shank having a coupling end and an opposed adapter end for operatively connecting with a grinding machine;

a grinding shaft having a driving portion coupling with said coupling end of said driving shank and an opposed free end portion arranged to be rotated when said driving portion is driven to rotate by said driving shank;

an abrasive arrangement which comprises a plurality of abrading elements spacedly and radially provided at said free end portion of said grinding shaft at an outer circumferential surface thereof such that when said grinding shaft is driven to rotate, said abrading elements are adapted for refining said workpiece surface; and a grinding agent dispenser for guiding a flow of grinding agent, comprising:

a guiding channel longitudinally provided within said grinding shaft from said driven portion towards said free end portion;

at least a dispensing channel radially extended from said grinding channel at a position adjacent to said abrading elements for evenly dispensing said grinding agent towards said abrading elements by a centrifugal force of said grinding shaft for optimizing an operative condition of said abrading elements during refining said workpiece surface; and a supplying arrangement for feeding said grinding agent to said guiding channel, wherein said supplying arrangement comprises a holding seat rotatably encircling with said driving shank, a supplying channel longitudinally provided within said driving shank to communicate with said guiding channel, and a supplying inlet provided at said holding seat for feeding said grinding agent into said guiding channel through said supplying channel.

10. The grinder, as recited in claim 9, wherein said supplying arrangement further has at least a supplying groove radially and outwardly extended from said driving shank to communicate said supplying channel with said supplying inlet for supplying said grinding agent from said supplying inlet to said supplying channel through said supplying groove when said driving shank is idle.

11. A grinder for refining of a workpiece surface, comprising:

a driving shank having a coupling end and an opposed adapter end for operatively connecting with a grinding machine;

a grinding shaft having a driving portion coupling with said coupling end of said driving shank and an opposed free end portion arranged to be rotated when said driving portion is driven to rotate by said driving shank;

an abrasive arrangement which comprises a plurality of abrading elements spacedly and radially provided at said free end portion of said grinding shaft at an outer circumferential surface thereof such that when said grinding shaft is driven to rotate, said abrading elements are adapted for refining said workpiece surface; and a grinding agent dispenser for guiding a flow of grinding agent, comprising:

a guiding channel longitudinally provided within said grinding shaft from said driven portion towards said free end portion; and at least a dispensing channel radially extended from said grinding channel at a position adjacent to said abrading elements for evenly dispensing said grinding agent towards said abrading elements by a centrifugal force of said grinding shaft for optimizing an operative condition of said abrading elements during refining said workpiece surface, wherein said guiding channel is coaxially formed with respect to said grinding shaft at a center thereof to define a hollow portion of said grinding shaft for guiding said grinding agent flowing along said grinding shaft, wherein said dispensing channel is radially extended from said guiding channel to form a dispensing outlet at said outer circumferential surface of said grinding shaft; and a supplying arrangement for feeding said grinding agent to said guiding channel, wherein said supplying arrangement comprises a holding seat rotatably encircling with said driving shank, a supplying channel longitudinally provided within said driving shank to communicate with said guiding channel, and a supplying inlet provided at said holding seat for feeding said grinding agent into said guiding channel through said supplying channel.

12. The grinder, as recited in claim 11, wherein said supplying arrangement further has at least a supplying groove radially and outwardly extended from said driving shank to communicate said supplying channel with said supplying inlet for supplying said grinding agent from said supplying inlet to said supplying channel through said supplying groove when said driving shank is idle.

* * * * *